US009086251B2

(12) United States Patent
Cummings

(10) Patent No.: US 9,086,251 B2
(45) Date of Patent: Jul. 21, 2015

(54) INDEXING PNEUMATIC LAUNCHER FOR MULTIPLE TOY ROCKET PROJECTILES

(71) Applicant: Peter Cummings, Kowloon (HK)

(72) Inventor: Peter Cummings, Kowloon (HK)

(73) Assignee: KHA Concepts Limited, TST, Kowloon (HK)

( * ) Notice: Subject to any disclaimer, the term of this patent is extended or adjusted under 35 U.S.C. 154(b) by 0 days.

(21) Appl. No.: 14/053,746

(22) Filed: Oct. 15, 2013

(65) Prior Publication Data

US 2015/0101584 A1 Apr. 16, 2015

(51) Int. Cl.
*F41B 11/00* (2013.01)
*F41B 11/50* (2013.01)

(52) U.S. Cl.
CPC ..... *F41B 11/50* (2013.01)

(58) Field of Classification Search
USPC ..... 124/63–66; 446/197
See application file for complete search history.

(56) References Cited

U.S. PATENT DOCUMENTS

| | | | | | |
|---|---|---|---|---|---|
| 278,005 | A | * | 5/1883 | Fredericks | 124/62 |
| 399,882 | A | * | 3/1889 | Graydon | 124/59 |
| 650,633 | A | * | 5/1900 | Cooper | 124/64 |
| 1,033,094 | A | * | 7/1912 | Fuda | 124/64 |
| 2,993,297 | A | | 7/1961 | Bednar | |
| 3,621,828 | A | * | 11/1971 | Schreiner | 124/8 |
| 3,628,416 | A | * | 12/1971 | Kernan | 89/1.51 |
| 3,752,082 | A | * | 8/1973 | Kernan | 102/342 |
| 3,949,518 | A | * | 4/1976 | Lenza | 446/186 |
| 3,985,047 | A | | 10/1976 | Therkelsen | |
| 4,076,006 | A | | 2/1978 | Breslow et al. | |
| D248,498 | S | * | 7/1978 | Kambayashi | D21/454 |
| 4,174,835 | A | * | 11/1979 | Breslow et al. | 273/357 |
| 4,186,927 | A | * | 2/1980 | Breslow et al. | 273/357 |
| 4,223,472 | A | * | 9/1980 | Fekete et al. | 446/192 |
| 4,411,249 | A | * | 10/1983 | Fogarty et al. | 124/64 |
| 4,897,065 | A | * | 1/1990 | Fertig et al. | 446/63 |
| 5,249,563 | A | * | 10/1993 | Patenaude | 124/8 |
| 5,343,850 | A | * | 9/1994 | Steer | 124/64 |
| D351,432 | S | * | 10/1994 | Dudeck et al. | D21/452 |
| 5,471,968 | A | * | 12/1995 | Lee | 124/64 |
| 5,596,978 | A | * | 1/1997 | Johnson et al. | 124/72 |
| 5,724,955 | A | * | 3/1998 | Johnson et al. | 124/72 |
| 5,970,969 | A | * | 10/1999 | Anttila et al. | 124/8 |
| 6,079,954 | A | * | 6/2000 | Kownacki et al. | 417/63 |
| 6,176,229 | B1 | * | 1/2001 | Patenaude | 124/8 |
| 6,318,350 | B1 | * | 11/2001 | Williams | 124/71 |
| 6,460,531 | B1 | * | 10/2002 | Gourley et al. | 124/64 |
| 6,588,410 | B1 | * | 7/2003 | Graber | 124/8 |
| 6,926,579 | B2 | * | 8/2005 | Rappaport | 446/212 |
| 7,011,084 | B2 | * | 3/2006 | Richard | 124/78 |
| 2005/0016516 | A1 | * | 1/2005 | Richard | 124/78 |

* cited by examiner

*Primary Examiner* — Michael David
(74) *Attorney, Agent, or Firm* — LaHorte & Associates, P.C.

(57) ABSTRACT

A toy launching assembly for pneumatically launching toy projectiles. The toy launching assembly has a base structure that contains an open port. A tube carousel rotates atop the base structure. The tube carousel holds a plurality of launching tubes. A pulse of air is generated by rapidly compressing an air bladder. The pulse of air travels through an air hose to the base structure. Within the base structure, the pulse of air is directed to the open port under the tube carousel. An indexing mechanism is used to rotate the tube carousel and sequentially positions one of the launching tubes over the open port each time the air bladder is sufficiently compressed. Once positioned over the open port, the pulse of air generated by the air bladder travels through the launching tube and displaces a toy projectile from the launching tube.

9 Claims, 4 Drawing Sheets

INDEXING PNEUMATIC LAUNCHER FOR MULTIPLE TOY ROCKET PROJECTILES

BACKGROUND OF THE INVENTION

1. Field of the Invention

In general, the present invention relates to manually operated pneumatic launchers for toy projectiles. More particularly, the present invention relates to pneumatic launchers that hold and automatically reload multiple toy projectiles.

2. Prior Art Description

There are many toy projectile launchers that work by squeezing an air bladder to create a pulse of air, and then using the pulse of air to launch a projectile from a tube. Many such launchers are handheld guns, where the air bladder is compressed by the hand of the user holding the gun. The problem with such toy projectile launchers is that a bladder compressed by hand, especially a child's hand, can only create a small pulse of air. Consequently, only small projectiles can be launched and those projectiles can only be launched at limited speeds.

In order to launch larger toy projectiles at greater speeds, toys were designed with air bladders that are separate from the launcher. The air bladder is designed to be placed on the ground and jumped upon by the user. By jumping onto the air bladder, the air bladder is compressed with the full weight of the user. Thus, even a child can produce a significant pulse of air.

The first toy projectile launcher that used a separate foot-compressed air bladder was presented in 1961 in U.S. Pat. No. 2,993,297 to Bednar, entitled Toy Rocket. Since then, a variety of commercial products have come to market using the concept. Many of the commercial products represent variations on the theme and show a toy rocket projectile in some form that is launched by some form of a foot-compressed air bladder. The variant toys are exemplified by U.S. Pat. No. 4,076,006 to Breslow, entitled Toy Rocket With Pneumatic Launcher.

Although many variations of the toy projectile launcher have been produced, they all share a common limitation. That limitation is that the launchers can only fire a single projectile and after each shot, the launcher must be reloaded. As such, after one toy projectile is launched, the next projectile cannot be launched for several seconds. Furthermore, if the launcher is being operated by only a single person, that person must bend down to load a projectile on the launcher and then jump up to stomp on the air bladder. If done many times in rapid succession, this can become physically exhausting.

The play value of a toy projectile launcher with a foot-compressed air bladder can be significantly increased if the launcher was capable of automatically reloading itself after a projectile is fired. In this manner, a person could fire multiple projectiles as fast as a person can jump on the air bladder. This need is met by the present invention as described and claimed below.

SUMMARY OF THE INVENTION

The present invention is a toy launching assembly for pneumatically launching toy projectiles. The toy launching assembly has a base structure that contains an open port. A tube carousel is supported by the base structure. The tube carousel holds a plurality of launching tubes. The tube carousel is capable of rotating atop the base structure.

A pulse of air is generated by rapidly compressing an air bladder. The pulse of air travels through an air hose to the base structure. Within the base structure, the pulse of air directed to the open port under the tube carousel.

An indexing mechanism is used to rotate the tube carousel and sequentially positions one of the launching tubes over the open port each time the air bladder is sufficiently compressed. In this manner, all of the launching tubes are rotated in turn over the open port. Once positioned over the open port, the pulse of air generated by the air bladder travels through the launching tube and displaced a toy projectile from the launching tube. Consequently, multiple toy projectiles can be launched from multiple launching tubes by simply compressing the air bladder multiple times. After each compression cycle, the tube carousel indexes and a different launching tube and projectile are pneumatically linked to the air bladder.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention rocket launching assembly can be embodied in many ways and can be used to launch any plurality of toy rocket projectiles, the embodiment illustrated shows a system designed to hold six toy rocket projectiles. This embodiment is selected in order to set forth one of the best modes contemplated for the invention. The illustrated embodiment, however, is merely exemplary and should not be considered a limitation when interpreting the scope of the appended claims.

Figure 1:
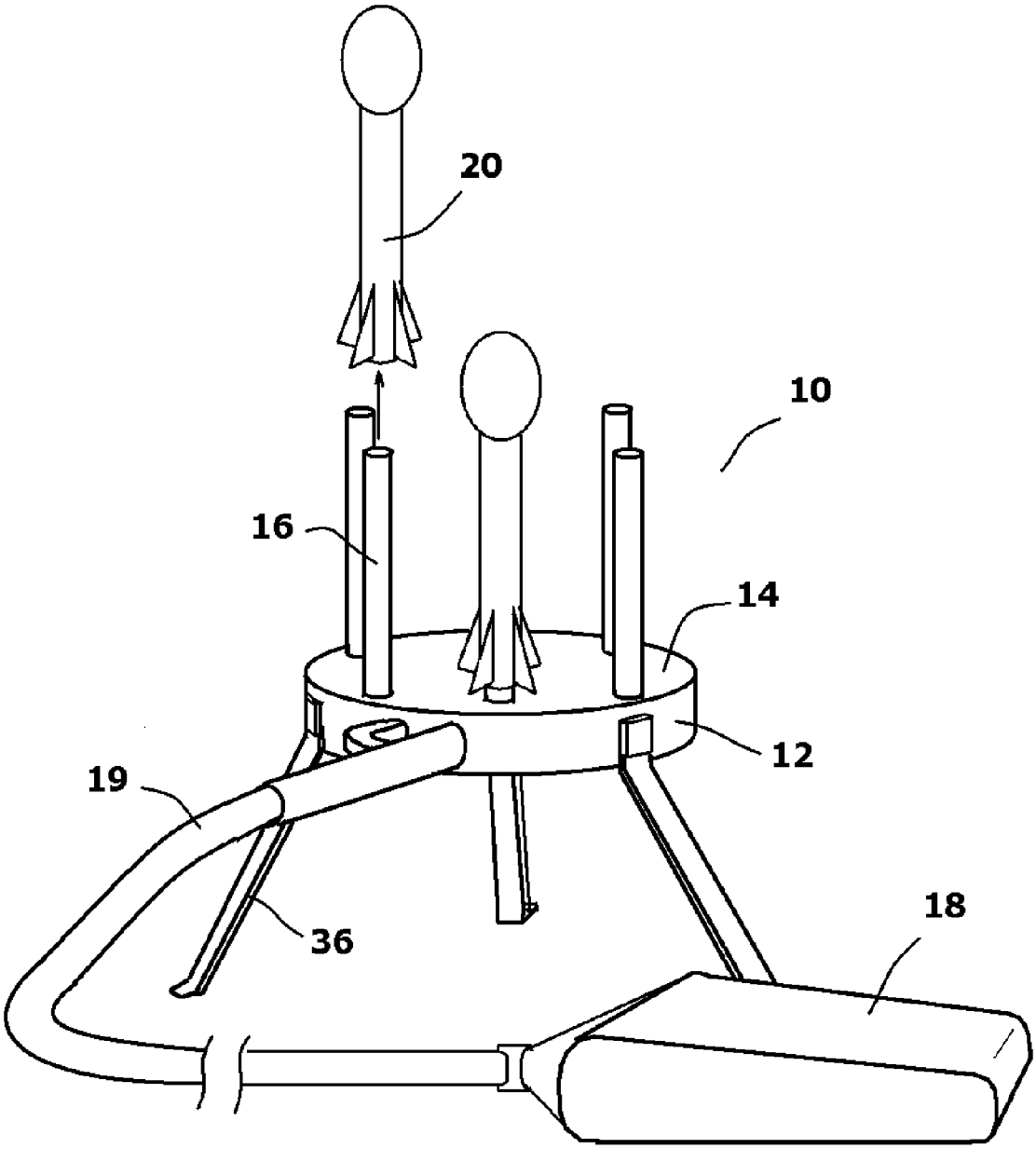
FIG. 1 is a perspective view of an exemplary embodiment of a toy projectile launching assembly.
Figure 2:
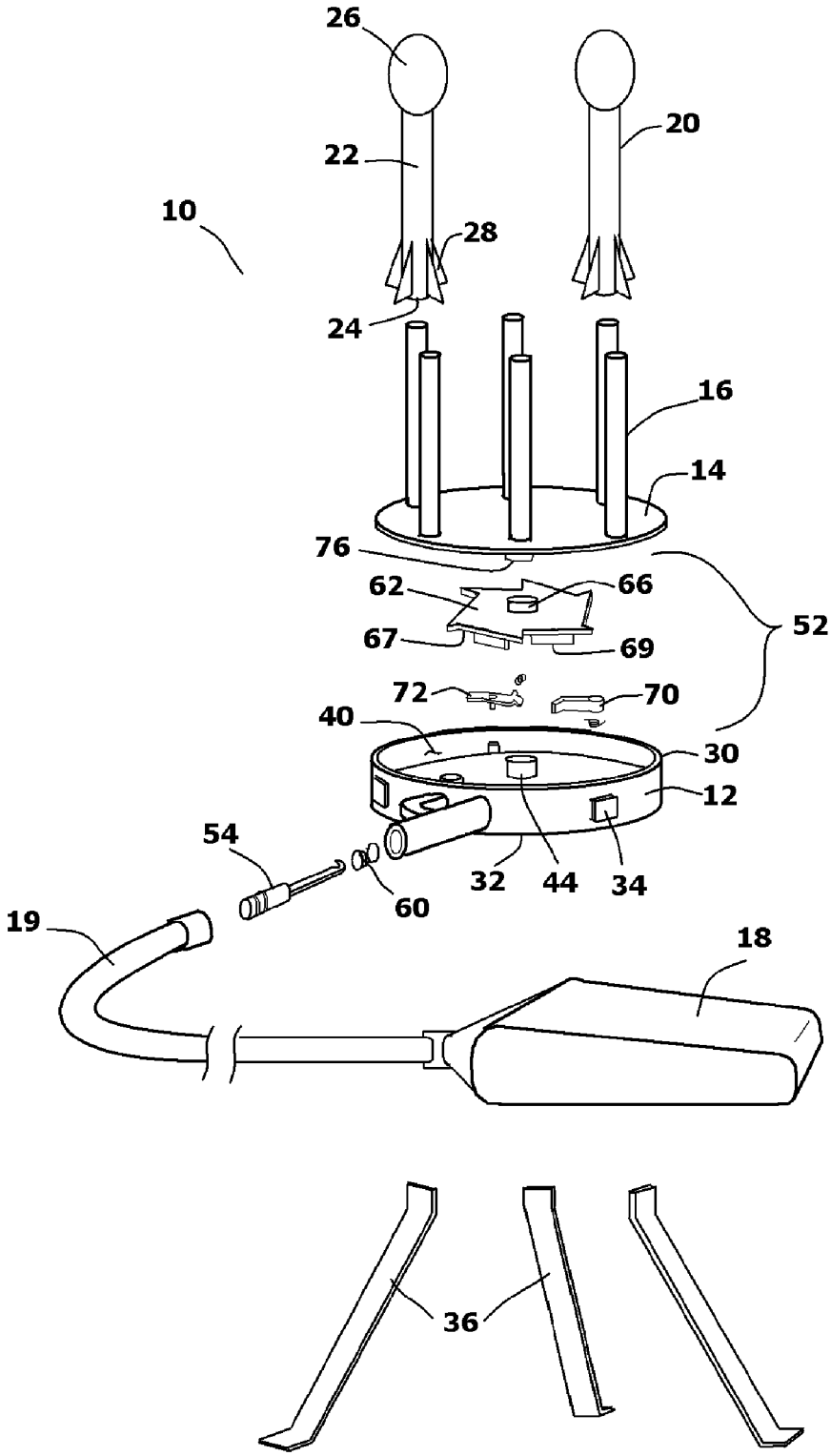
FIG. 2 is an exploded view of the exemplary embodiment of FIG. 1.

Referring to FIG. 1 in conjunction with FIG. 2, a rocket launching assembly 10 is shown. The rocket launching assembly 10 contains a launching base 12 upon which is affixed a rotating tube carousel 14. The tube carousel 14 carries a plurality of vertical launching tubes 16. An air bladder 18 is provided. The air bladder 18 is connected to the launching base 12 by a flexible hose 19. To utilize the rocket launching assembly 10, a plurality of toy rocket projectiles 20 are placed onto the vertical launching tubes 16. When a person steps on the air bladder 18, air is displaced through the flexible hose 19. The displaced air travels into whichever of the vertical launching tubes 16 that is in the launching position. The displaced air then causes the toy rocket projectile 20 to launch into the air. The speed of the launch is determined by how much air is displaced from the air bladder 18 and how quickly that amount of air is displaced. A minimum threshold of air pressure is required for operation.

Once a toy rocket projectile 20 is launched from the tube carousel 14, the pneumatic forces created during the launch are also used to index the tube carousel 14. The vertical launching tubes 16 rotate as a unit and the next sequential vertical launching tube is sequentially moved to the launch position. The launch cycle can then be repeated until all of the toy rocket projectiles 20 that are loaded onto the tube carousel 14 have been launched.

Each of the toy rocket projectiles 20 is comprised primarily of a hollow tube 22. The hollow tube 22 has a closed top end and an open bottom end 24. The top end of the hollow tube 22 is terminated with a safety head 26. The safety head 26 is preferably made of a soft synthetic foam polymer. Stabilizing fins 28 can be affixed to the outside of the hollow tube 22, near the open bottom end 24 to help the toy rocket projectile 20 fly straight when launched.

The air bladder 18 is a collapsible container. The air bladder 18 is made of resilient material that enables the air bladder 18 to self-inflate after each time it is compressed. The preferred capacity of the air bladder 18 is between 0.25 liters and one liter.

The air bladder 18 is connected to the flexible hose 19. Air can only enter and exit the air bladder 18 through the flexible hose 19. As such, when the air bladder 18 is compressed, air is displaced from the air bladder 18 into the flexible hose 19. Conversely, when the air bladder 18 self inflates, air is drawn into the air bladder 18 through the flexible hose 19.

The launching base 12 has a circular housing 30. The circular housing 30 preferably has a flat bottom surface 32 that enables the launching base 12 to rest on a flat surface. Furthermore, the circular housing 30 also contains a plurality of external mounts 34 that enable support legs 36 to be selectively mounted to the housing 30. In this manner, the launching base 12 can be supported by the legs 36, if desired by the user.

Figure 3:
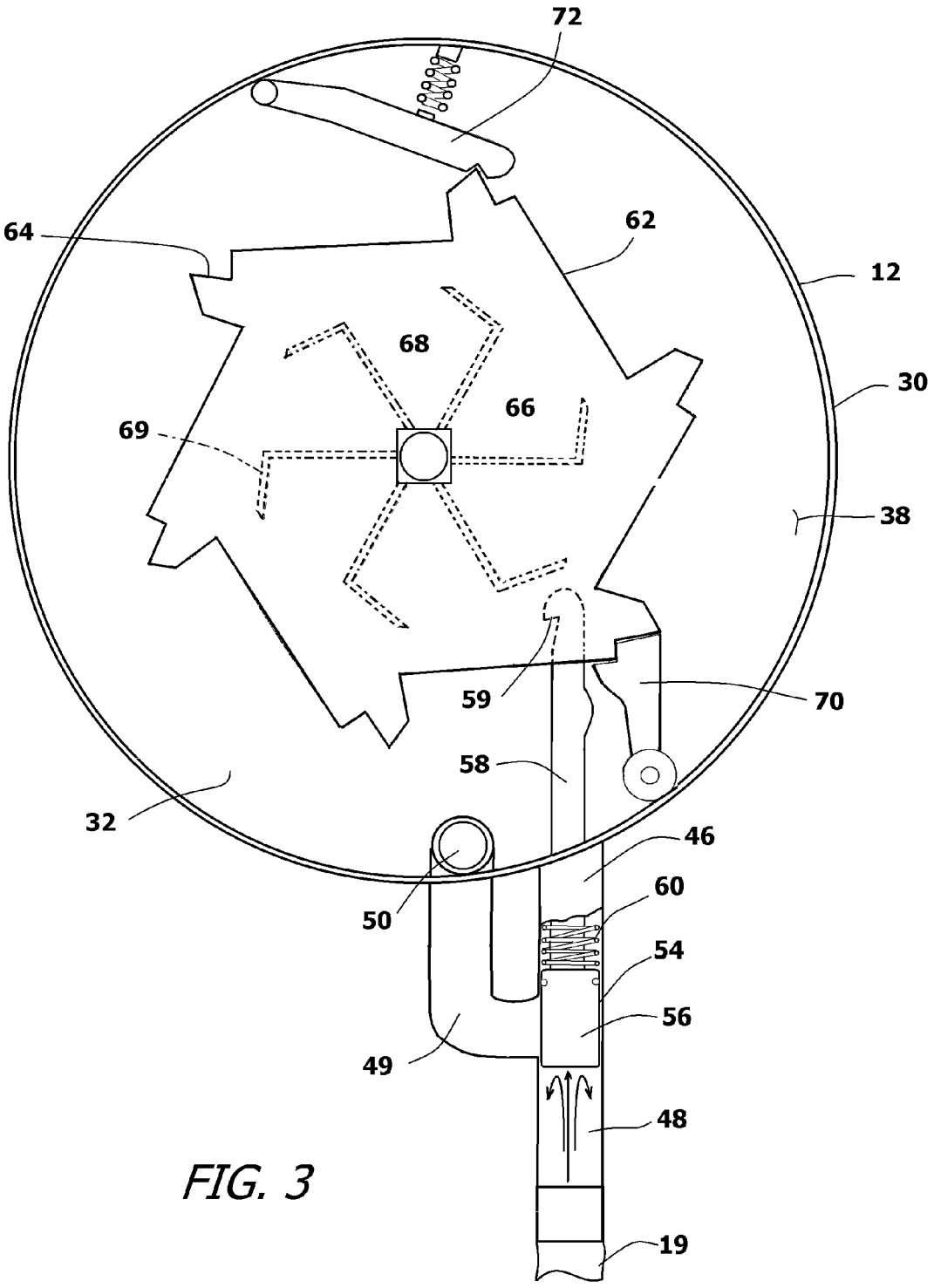
FIG. 3 is a partially fragmented view of the exemplary embodiment showing the top surface features of the indexing wheel with solid lines and the bottom surface features of the indexing wheel in hidden lines.

Referring to FIG. 3 in conjunction with FIG. 2, it can be seen that the circular housing 30 of the launching base 12 defines an interior 38 having an open top 40. The interior 38 is defined by the flat bottom surface 32 surrounded by a vertical peripheral wall 42. In the center of the flat bottom surface 32 is a vertical post 44.

The circular housing 30 is coupled to a manifold 46. The manifold 46 connects to the flexible hose 19 that leads to the air bladder 18. The manifold 46 has a main conduit 48 and a branch conduit 49. The branch conduit 49 leads to an open launch port 50. The top of the open launch port 50 is coplanar with the open top 40 of the circular housing 30.

A pneumatic indexing mechanism 52 is disposed within the launching base 12. The indexing mechanism 52 is used to rotate the tube carousel 14 after each time a toy rocket projectile 20 is launched. The indexing mechanism 52 utilizes a piston 54 in the main conduit 48 of the manifold 46. The piston 54 has a piston head 56 that is linked to a piston arm 58. Both the piston head 56 and the piston arm 58 are biased into a low first position within the main conduit 48 by a recoil spring 60. In the low first position, the piston head 56 obstructs the branch conduit 49. The piston arm 58 has a hook 59 at its distal end. The function of the piston 54 is later described.

Figure 4:
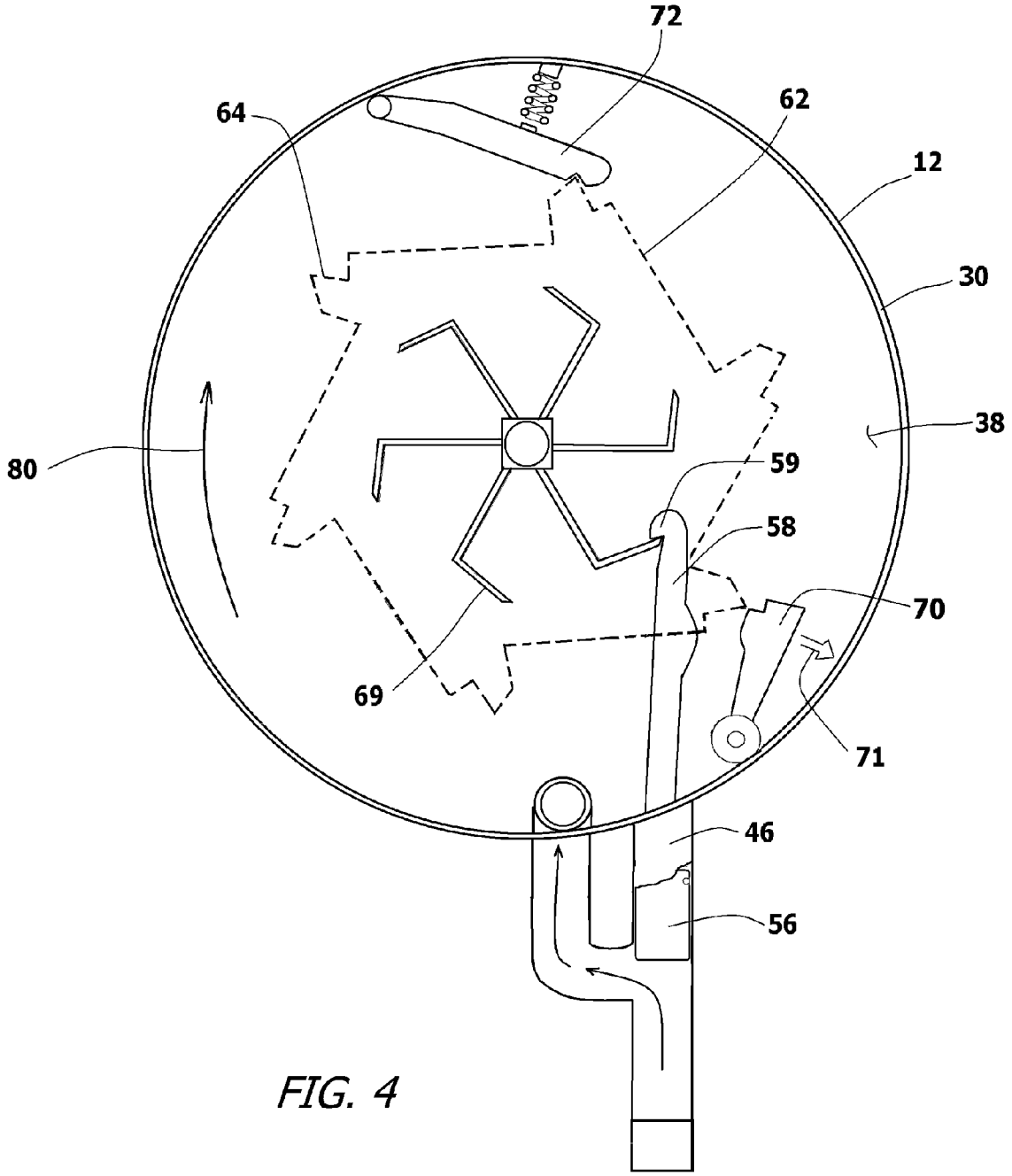
FIG. 4 is a partially fragmented view of the exemplary embodiment showing the bottom surface features of the indexing wheel with solid lines and the bottom surface features of the indexing wheel in hidden lines.

The indexing mechanism 52 also utilizes an indexing wheel 62. The indexing wheel 62 is positioned within the interior 38 of the circular housing 30. The indexing wheel 62 engages the vertical post 44, wherein the indexing wheel 62 is free to rotate around the vertical post 44 in the center of the circular housing 30. Referring to FIG. 4 in conjunction with FIG. 2 and FIG. 3, it can be seen that the indexing wheel 62 contains a plurality of salient points 64 that are symmetrically disposed around a central hub 66. The central hub 66 itself projects vertically and presents a keyed attachment termination 68.

On the opposite bottom surface 67 of the indexing wheel 62, the central hub 66 is hollow so it can receive the vertical post 44 around which the indexing wheel 62 spins. A plurality of catches 69 are formed on the bottom surface 67.

When the indexing wheel 62 is positioned on the vertical post 44 in the open interior 38 of the circular housing 30, the indexing wheel 62 would normally be free to rotate. However, two spring pawls 70, 72 are provided that engage different salient points 64 of the indexing wheel 62 and prevent the indexing wheel 62 from rotating. The first spring pawl 70 prevents the indexing wheel 62 from rotating in a clockwise direction; as viewed in FIG. 3. The second spring pawl 70 prevents the indexing wheel 62 from rotating in a counterclockwise direction; as viewed in FIG. 3.

The tube carousel 14 covers the open top 40 of the circular housing 30. The tube carousel 14 holds the vertical launching tubes 16. The vertical launching tubes 16 are parallel and are arranged symmetrically in a circular pattern. The tube carousel 14 has a base plate 74. The base plate 74 is the same shape as the open top 40 of the circular housing 30 and covers the open top 40 of the circular housing 30. The base plate 74 has a central nub 76 around which all of the vertical launching tubes 16 are symmetrically positioned. The central nub 76 contains a relief sized and shaped to engage the keyed attachment termination 68 on the central hub 66 of the indexing wheel 62. In this manner, the base plate 74 and all the vertical launching tubes 16 turn in unison with the indexing wheel 62.

Each of the vertical launch tubes 16 has an open bottom end. The open bottom end is not obstructed by the base plate 74 in the tube carousel 14. When the tube carousel 14 rotates within the open interior 38 of the launching base 12, the open bottom ends of each of the vertical launching tubes 16 sequentially passes directly over the open launch port 50. When a particular vertical launching tube 16 is positioned over the open launch port 50, that vertical launching tube 16 is said to be in its launch position.

To utilize the present invention, the rocket launching assembly 10 is placed on a stable surface. Toy rocket projectiles 20 are then slipped over the various vertical launching tubes 16. A user then jumps or otherwise forcefully compresses the air bladder 18. The air bladder 18 collapses and air is displaced through the flexible hose 19.

Referring to FIG. 4 in conjunction with FIG. 3 and FIG. 2, it can be will be understood that the air displaced by the air bladder 18 increases the air pressure in the manifold 46. If the increase in air pressure surpasses a certain threshold, then the air pressure causes the piston head 56 and piston arm 58 to move against the bias of the recoil spring 60. Once the piston head 56 clears the branch conduit 49, the air travels through the branch conduit 49 to the open launch port 50 and into whatever vertical launching tube 16 that is in the launching position. The influx of air displaces the toy rocket projectile 20 from the affected vertical launching tube 16 and launches it into flight.

Furthermore, as the piston head 56 and the piston arm 58 are displaced by the inflow of air, the piston arm 58 is driven into the open interior 38 of the circular housing 30. As the piston arm 58 is driven into the circular housing 30, it performs two functions. First, the piston arm 58 strikes the first spring pawl 70 and disengages the first spring pawl 70 from the indexing wheel 62 by driving it in the direction of arrow 71. This enables the indexing wheel 62 to rotate in the direction of arrow 80. Second, the hook 59 at the distal end of the piston arm 58 engages one of the plurality of catches 69 on the bottom surface 67 of the indexing wheel 62.

As the increase of air pressure in the manifold dissipates, the recoil spring 60 moves the piston head 56 and the piston arm 58 back to their initial first position. However, the piston arm 58 is hooked onto one of the catches 69 on the indexing wheel 62. As a consequence, the piston arm 58 pulls on the catch 69 and causes the indexing wheel 62 to rotate in the direction of arrow 80.

As the indexing wheel 62 rotates, the first spring pawl 70 resets and engages the next salient point 64 on the indexing wheel 62. This stops the indexing wheel 62 from rotating. As the indexing wheel 62 rotates, the interconnected tube carousel 14 rotates atop the circular housing 30. This positions the next subsequent vertical launching tube 16 directly over the open launching port 50. The launching sequence can then be repeated until all the toy rocket projectiles 20 on all the vertical launching tubes 16 are launched.

It will be understood that the embodiment of the present invention that is illustrated and described is merely exemplary and that a person skilled in the art can make many variations to that embodiment. For instance, the rocket launching assembly can hold any number of toy rocket projectiles. Likewise, the vertical tubes on the tube carousel need not all be parallel. All such alternate embodiments are considered to be matters of design choice and are intended to be included within the scope of the present invention as defined by the claims.

What is claimed is:

1. A toy launching assembly for pneumatically launching toy rockets, said assembly comprising:

a base structure containing an open port;

a tube carousel supported by said base structure, wherein said tube carousel contains a plurality of launching tubes, and wherein said tube carousel is capable of rotating relative to said base structure;

an indexing wheel coupled to said tube carousel, wherein said indexing wheel and said tube carousel turn in unison;

a flexible hose;

an air bladder that is pneumatically connected to said open port by said flexible hose;

a piston having a piston arm, wherein said piston arm extends and rotates said indexing wheel causing said tube carousel to turn and sequentially position one of said plurality of launching tubes over said open port each time said air bladder is compressed sufficiently to create a threshold air pressure within said flexible hose; and a conduit that connects said flexible hose to said open port, and wherein said piston at least partially obstructs said conduit when said threshold air pressure is not achieved within said flexible hose.

2. The assembly according to claim 1, wherein said plurality of launching tubes are arranged in parallel on said tube carousel.

3. The assembly according to claim 1, further including a first spring pawl biased into contact with said indexing wheel, wherein said first spring pawl prevents said indexing wheel from rotating in a first direction when engaged with said indexing wheel.

4. The assembly according to claim 3, wherein said piston arm contacts and disengages said first spring pawl from said indexing wheel when said piston arm extends and rotates said indexing wheel.

5. The assembly according to claim 3, further including a second spring pawl biased into contact with said indexing wheel, wherein said second spring pawl prevents said indexing wheel from rotating in a second direction when engaged with said indexing wheel, wherein said second direction is opposite said first direction.

6. A toy rocket launching assembly comprising:

a launching base containing a carousel that supports a plurality of launching tubes, wherein said carousel rotates said plurality of launching tubes past a launching position;

a plurality of toy rocket projectiles that slide onto said plurality of launching tubes;

a manually operated air source coupled to said launching base for creating a pulse of air; and an indexing wheel coupled to said carousel, wherein said indexing wheel rotates with said carousel;

a piston having a piston arm, wherein said piston arm moves said indexing wheel when said pulse of air is generated by said manually operated air source, therein sequentially moving said plurality of launching tubes into said launching position; and a first spring pawl biased into contact with said indexing wheel, wherein said first spring pawl prevents said indexing wheel from rotating in a first direction when engaged with said indexing wheel; and wherein said piston arm contacts and disengages said first spring pawl from said indexing wheel when said piston is activated.

7. The assembly according to claim 6, wherein said manually operated air source is a compressible air bladder.

8. The assembly according to claim 7 wherein said compressible air bladder is coupled to said launching base with a hose.

9. A toy launching assembly for pneumatically launching toy rockets, said assembly comprising:

a launching base containing a carousel that holds a plurality of launching tubes and rotates said plurality of launching tubes over a launching port one at a time;

an air bladder that is pneumatically connected to said launching port;

an indexing wheel for rotating said carousel and sequentially positioning one of said plurality of launching tubes over said launching port after each time said air bladder is compressed;

a piston having a piston arm, wherein said piston arm extends and engages said indexing wheel;

and a first spring pawl biased into contact with said indexing wheel, wherein said first spring pawl prevents said indexing wheel from rotating in a first direction when engaged with said indexing wheel, and wherein said piston arm contacts said first spring pawl and disengages said first spring pawl from said indexing wheel when said piston arm rotates said indexing wheel.

* * * * *